US006007460A

United States Patent [19]

Young

[11] Patent Number: 6,007,460

[45] Date of Patent: Dec. 28, 1999

[54] HAND EXERCISING DEVICE

[75] Inventor: Allen Young, Los Altos, Calif.

[73] Assignee: Meddev Corporation, Palo Alto, Calif.

[21] Appl. No.: 09/088,959

[22] Filed: Jun. 2, 1998

[51] Int. Cl.[6] ..... A63B 23/14

[52] U.S. Cl. ..... 482/49; 482/121; 482/126; 482/44

[58] Field of Search ..... 482/44, 49, 121, 482/126, 79, 71; 73/379.01, 379.02, 379.03; D21/682, 683, 864

[56] References Cited

U.S. PATENT DOCUMENTS

| | | | |
|---|---|---|---|
| Re. 28,845 | 6/1976 | Ratchford | 482/49 |
| 1,495,278 | 5/1924 | Titus . | |
| 2,205,161 | 6/1940 | Vick | 482/49 |
| 2,621,652 | 12/1952 | Ehrhardt . | |
| 3,524,641 | 8/1970 | Ossenkop | 482/71 |
| 3,547,434 | 12/1970 | Ossenkop | 482/71 |
| 3,570,849 | 3/1971 | Ratchford . | |
| 4,226,412 | 10/1980 | Panepinto . | |
| 4,553,746 | 11/1985 | Lee . | |
| 4,783,067 | 11/1988 | Palmer | 482/49 |
| 5,125,878 | 6/1992 | Wingate et al. . | |
| 5,279,530 | 1/1994 | Hess | 482/79 X |
| 5,317,916 | 6/1994 | Kovaceic | 482/49 X |
| 5,611,755 | 3/1997 | Blackmore | 402/49 |
| 5,855,538 | 1/1999 | Argabright | 482/79 X |

OTHER PUBLICATIONS

Petrofsky, Digital Controlled Hardgrip . . . , (IEEE) Biomedical Eng Lab, Wright State University, 1981.

*Primary Examiner*—Richard J. Apley
*Assistant Examiner*—William LaMarca
*Attorney, Agent, or Firm*—Flehr Hohbach Test Albritton & Herbert LLP

[57] ABSTRACT

An exercising apparatus. The exercise apparatus includes an outer frame having curved first and second rails and an outer handle between the rails, and an inner frame slidably coupled to the outer frame for movement of the inner frame along the first and second rails. The inner frame includes an inner handle movable toward the outer handle when the inner frame is moved in a first direction. The apparatus also includes at least one resistance device coupling the inner and outer frames together, the resistance device resisting movement of the inner frame in the first direction.

12 Claims, 2 Drawing Sheets

HAND EXERCISING DEVICE

BRIEF DESCRIPTION OF THE INVENTION

The present invention relates in general to a hand exercising device and, more particularly, to an apparatus and method for strengthening the hands and forearms.

BACKGROUND OF THE INVENTION

Various exercise devices are available for increasing the strength and range of motion of the muscles and tendons in the hands and forearms. One type of exercise device is typically operated with one hand by grasping a pair of spaced handles in one hand and repeatedly closing the hand to move the handles together. The operation of this type of device typically uses many of the muscles and tendons of the hand and forearm. However, in some instances emphasizing specific muscles and tendons would be useful. Placing emphasis on muscles and tendons would provide considerable variation in muscle interaction, providing beneficial results during rehabilitation from an injury or surgery, or even in the prevention of repetitive stress injuries such as carpal tunnel syndrome. An exercise device which may be used to exercise the hand and forearm while emphasizing selected muscles and tendons is desirable.

U.S. Pat. Nos. 3,570,849, 5,125,878 and 5,611,755 disclose exercise devices which include an outer frame with a pair of spaced rods and an inner frame which slides along the rods. With the devices shown in U.S. Pat. Nos. 3,570,849 and 5,125,878, tensioning members couple the inner frame to the outer frame to supply the resistance for the exercise. The resistance may be easily adjusted by adding or removing tensioning members. With the device shown in U.S. Pat. No. 5,125,878, the distance initially separating the spaced handles may also be adjusted. The device shown in U.S. Pat. No. 5,611,755 may be used to exercise one or both hands, with the resistance being provided by the opposite hand. One of the rods of the outer frame is longer than the other to ensure the device is operated properly during the exercise, reducing the assistance of the stronger muscles of the upper arms, chest and back during the exercise.

An exercise device which may be used to emphasize specific muscles and tendons is desirable. A device which emphasizes different muscles and tendons depending upon how the exercise device is used is also desirable. Similarly, an exercise device in which the resistance may be easily adjusted without altering the device is desirable.

OBJECTS AND SUMMARY OF THE INVENTION

It is a primary object of the present invention to provide an exercising apparatus for exercising the hand and forearm.

It is a further object of the present invention to provide an exercising apparatus for emphasizing selected muscles and tendons during the exercise.

It is another object of the present invention to provide an exercising apparatus in which the individual may vary the amount of resistance provided by the apparatus.

It is yet another object of the present invention to provide an exercising apparatus in which the resistance may be adjusted without altering the apparatus.

It is a more general object of the present invention to provide an exercising apparatus which is easy and convenient to use, comfortable to the hands, and which may be efficiently and economically manufactured.

In summary, this invention provides an exercising apparatus which includes an outer frame having spaced first and second rails and an outer handle extending between the first and second rails. The first and second rails are curved. An inner frame is slidably coupled to the outer frame for movement of the inner frame along the first and second rails. The inner frame includes an inner handle which may be moved toward the outer handle when the inner frame is moved in a first direction and away from the handle when the inner frame is moved in a second direction. At least one resistance assembly couples the inner frame and the outer frame together to resist movement of the inner frame in the first direction.

Additional objects and features of the invention will be more readily apparent from the following detailed description and appended claims when taken in conjunction with the drawings.

DETAILED DESCRIPTION OF THE INVENTION

Figure 1:
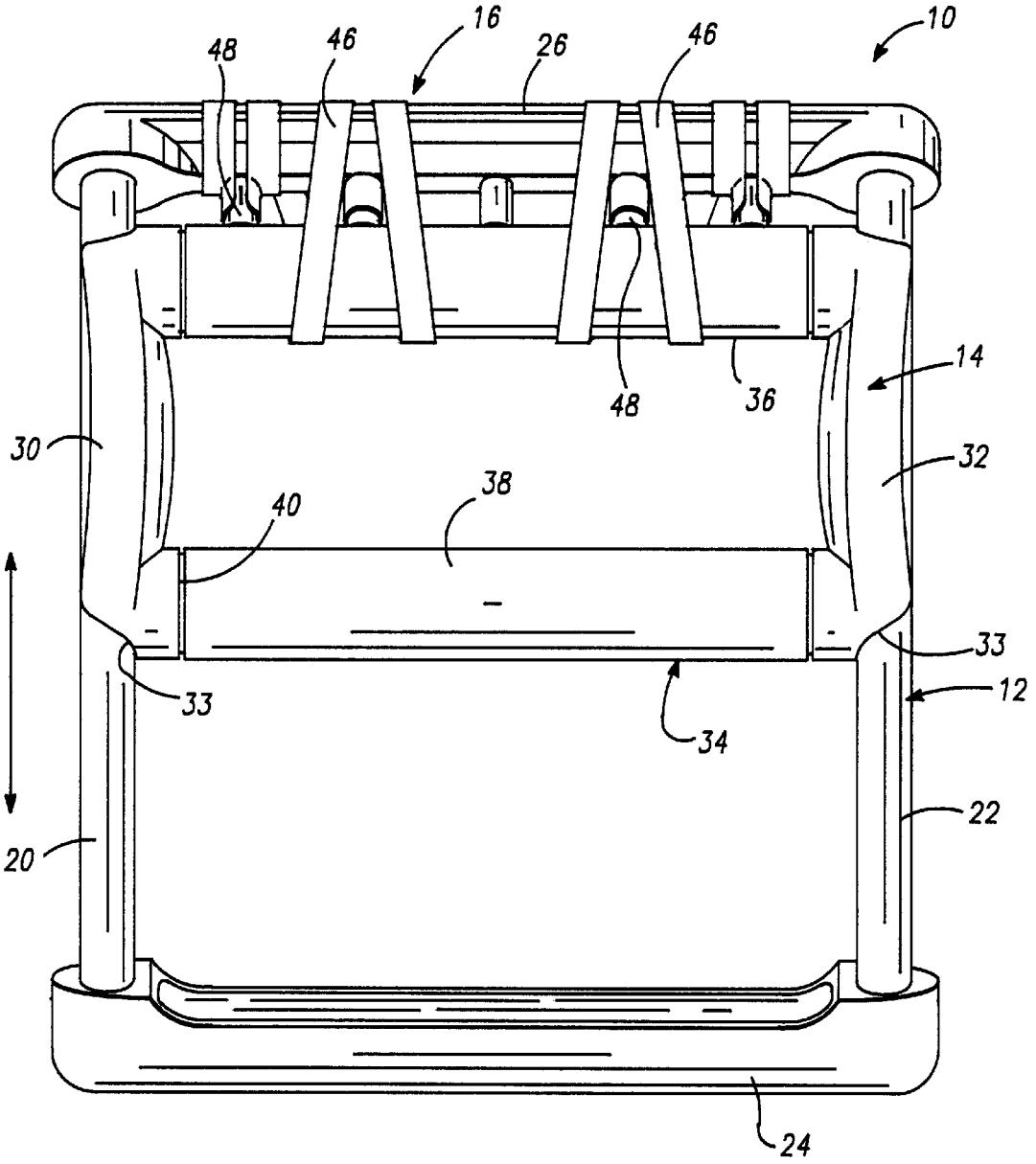
FIG. 1 is a front plan view of an exercising apparatus in accordance with the present invention.

Reference will now be made in detail to the preferred embodiment of the invention, which is illustrated in the accompanying figures. Turning now to the drawings, wherein like components are designated by like reference numerals throughout the various figures, attention is directed to FIGS. 1 and 2.

Exercise apparatus 10, constructed in accordance with the present invention, is particularly suitable for exercising the muscles of the hand and forearm and, as is discussed in more detail below, for emphasizing specific muscles, tendons and/or joints during the exercise session. The exercise apparatus 10 generally includes an outer frame 12 and an inner frame 14 which slides along the outer frame 12. A resistance assembly, generally designated at 16, resists the movement of the inner frame along the outer frame. The user exercises the hand and forearm by supplying enough force to overcome the resistance of the resistance assembly 16 and slide the inner frame 14 along the outer frame 12.

The outer frame 12 generally includes a pair of spaced-apart parallel rails 20, 22 which define the track for the sliding movement of the inner frame 14. As shown particularly in FIGS. 2–4, the rails 20, 22 are curved. The radius of curvature of the rails 20, 22 is subject to considerable variation. In the present embodiment, the rails 20, 22 have a radius of curvature of about 3 inches to 6 inches, for example 5 inches, although it is to be understood that the curvature may be increased or decreased in other embodiments of the invention. As indicated by FIGS. 1–4, the rails 20, 22 extend in curved paths in parallel planes which extend through the spaced-apart parallel rails. As a result, from one side the apparatus 10 has a generally concave appearance and from the other side the apparatus 10 has a generally convex appearance.

Figure 2:
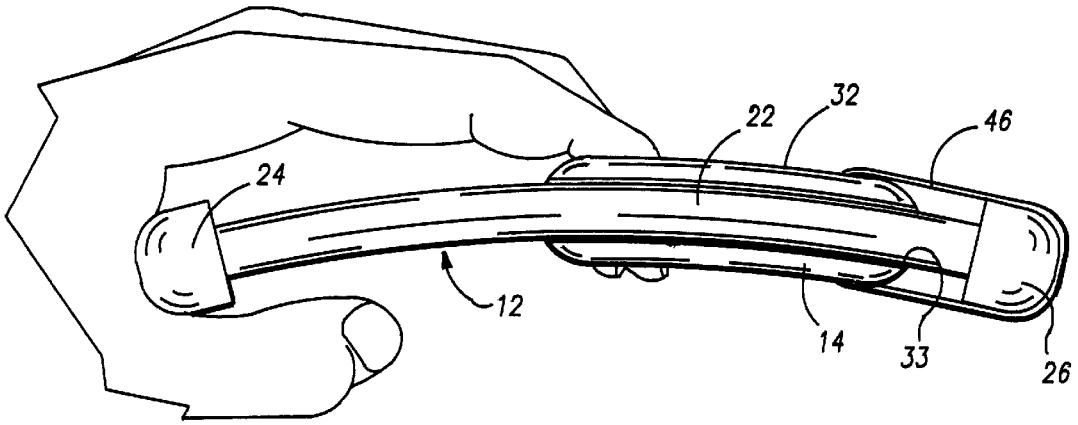
FIG. 2 is an end view of the exercising apparatus of FIG. 1, shown in a first exercise orientation with the inner frame in a released position.
Figure 3:
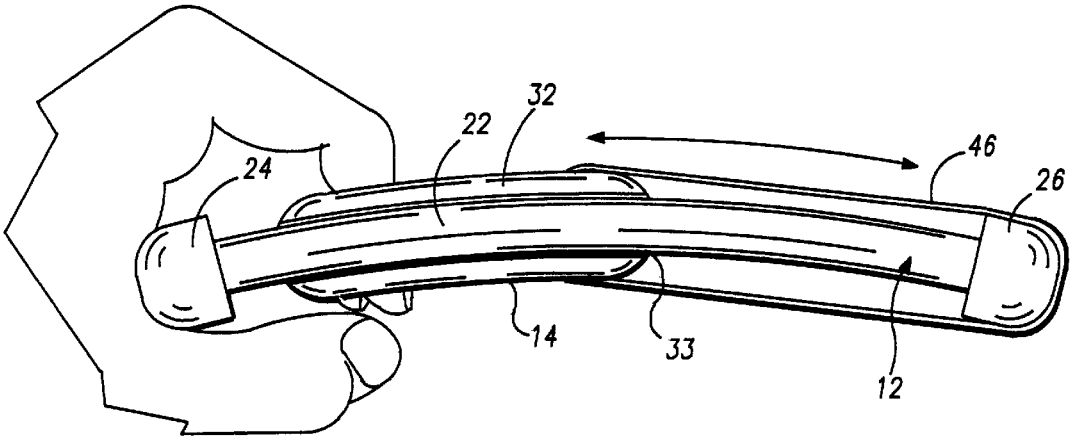
FIG. 3 is an end view of the exercising apparatus of FIG. 1, shown in the first exercise orientation with the inner frame in an engaged position.
Figure 4:
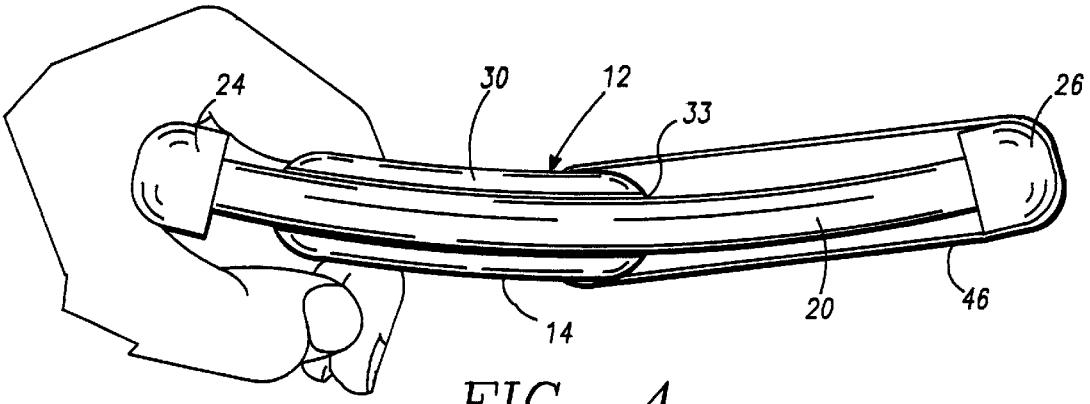
FIG. 4 is an end view of the exercising apparatus of FIG. 1, shown in a second exercise orientation with the inner frame in an engaged position.

In the illustrated embodiment of the invention, an outer handle 24 and an outter bar 26 extend between the rails 20, 22, providing the outer frame 12 with a rectangular configuration. However, it is to be understood that the rails 20, 22 may be joined together by different components. The outer handle 24 is shaped to seat in the palm of the hand as shown in FIGS. 2–4. Although not shown, the outer handle may include a cushion sleeve of the type shown in U.S. Pat. No. 5,125,878, the disclosure of which is incorporated herein by reference, to protect the hand and reduce any soreness or blistering which may occur during extensive exercise sessions. The cushion sleeve is preferably formed of a spongy, porous material which yields elastically when grasped by the hand. The outer bar 26 forms part of the resistance assembly 16 as discussed in more detail below.

The components of the outer frame are preferably manufactured of plastic using a suitable molding process. In the illustrated embodiment, the rails 20, 22, outer handle 24 and outer bar 26 are formed separately and then secured together using adhesive or other attachment means. Preferably, the inner frame 14 is mounted to the outer frame 12 by slipping the inner frame 14 onto the rails 20, 22 before the assembly of the outer frame 12 has been completed. Instead of separately molding each piece, it is to be understood that two, three or all of the components may be manufactured using a single mold. If the outer frame 12 is molded as a single piece, the design of the inner frame 14 is preferably m edified to facilitate mounting the inner frame to the outer frame.

The inner frame 14 generally includes a pair of slides 30, 32 which are seated on the rails 20, 22 of the outer frame 12. In the illustrated embodiment, the slides 30, 32 have a U-shaped configuration forming a recess 33 which is shaped to at least partially receive the respective rod 20, 22. The slides 30, 32 are preferably curved along the 5 longitudinal axis of the recess 33 as shown in FIGS. 2–4 so that the slides 30, 32 will move smoothly along the curved rails 20, 22. Instead of providing the slides 30, 32 with a curved configuration, the width of the recess 33 may be increased or the length of the slides 30, 32 may be reduced so that movement of the slides 30, 32 along the rails 20, 22 will not be significantly restricted. The slides 30, 32 may also be replaced by rings which encircle the rails 20, 22.

In this embodiment of the invention, an inner handle 34 and an inner bar 36 extend between the slides 30, 32. The inner handle 34 is gripped by the user and used to pull the inner frame 14 toward the outer handle 24. To provide a more natural hand stroke when the hand is closed to pull the inner frame 14 toward the outer handle 24, the inner handle 34 of this embodiment rotates relative to the inner frame 14. As shown particularly in FIG. 1, the inner handle 34 includes a hollow sleeve 38 which is carried by a crossbar 40 mounted between the slides 30, 32. The sleeve 38 is allowed to rotate relative to the crossbar 40 as the user's hand is closed around the inner and outer handles 34, 24. Other types of rotary handles may also be employed for the inner handle 34. For example, the inner handle may include pins on either end of the handle which are rotatably seated in openings formed in the slides 30, 32, with the pins permitting rotation of the handle relative to the slides 30, 32. Instead of a rotatable handle 34, the inner frame 14 may include a fixed handle. Alternatively, a rotatable handle 34 may be include a locking mechanism which allows the user to operate the apparatus 10 with either a fixed or rotating handle 34. For example, the handle 34 may include one or more pins (not shown) which anchors the cylinder 38 to shaft 40 to restrain rotation of the cylinder relative to the shaft. The pin or pins may be disengaged to allow cylinder 38 to rotate relative to the shaft. Other means may also be used to temporarily secure the rotatable handle 34 in a fixed position. Although not shown, the inner handle 34 may include a cushion sleeve of the type shown in U.S. Pat. No. 5,125,878 to increase the user's comfort during the exercise session.

The inner bar 36 forms part of the resistance assembly 16 as discussed in more detail below. In the illustrated embodiment, the inner bar 36 is substantially similar to the inner handle 34 and also rotates relative to the inner framed 14. Using identical components for the inner handle 34 and inner bar 36 reduces the cost of manufacture by reducing the number of different components as well as the additional step of orienting the inner frame 14 with the inner handle 34 opposite the outer handle 24. Another advantage is that the user may operate the apparatus 10 with two hands if desired, such as when the user may wish to use his other hand to supply resistance in addition to or instead of the resistance assembly 16. When operating the apparatus with two hands, the user would grasp the outer bar 26 and inner bar 36 and resist the movement of the inner bar away from the outer bar. Instead of using the same components for the inner handle 34 and inner bar 36, it is to be understood that the inner bar 36 may have other configurations. For example, the inner bar 36 may be fixed relative to the inner frame.

As shown in FIG. 1, the inner handle 34 and inner bar 36 are positioned at the opposite ends of the slides 30, 32. Thus, the slides 30, 32 are of a sufficient length to allow the user's fingers to fit between the inner handle 34 and inner bar 36 and grasp the inner handle to pull the inner frame 14 toward the outer handle 24 without grazing his fingers on the inner bar 36. If desired, the spacing between the inner handle 34 and inner bar 36 may be increased, although this would require increasing the overall size of the apparatus 10. In the modifications discussed above, where short slides which are not curved to follow the rails 20, 22 or rings which encircle the rails 20, 22 are employed, the slides are not used to define the spacing between the inner handle 34 and the inner bar 36 and the inner frame includes other components, such as transverse bars between the inner handle 34 and inner bar 36, to determine the spacing between the handle 34 and bar 36.

The inner frame 14 is moved along the outer frame 12 by the user to alternately slide the inner handle 34 toward and away from the outer handle 24 during the exercise activity. FIG. 2 shows the inner frame 14 positioned in the released position; that is, the resistance assembly 16 has pulled the inner frame 14 against the outer bar 26. FIG. 3 shows the inner frame in the engaged position, with the user pulling the inner frame 14 toward the outer handle. The movement between the released and engaged positions is accomplished by placing the outer handle 24 in the palm of the hand and the fingers on the inner handle 34 and then repeatedly opening and closing the hand. The sliding movement of the inner frame 14 is resisted by the resistance assembly 16, which couples the inner frame 14 to the outer frame 12. In the illustrated embodiment, the outer bar 26 and inner bar 36 both form part of the resistance assembly 16. The resistance assembly 16 further includes at least one tensioning member 46 which couples the inner bar 36 to the outer bar 26. In the illustrated embodiment, the tensioning member 46 is provided by an endless elastic band or other elastomer which stretches and provides a resisting force when the inner frame 14 is moved along the outer frame 12. A plurality of fasteners 48 are carried by the outer bar 26. The endless band 46 is wrapped around the inner bar 36 and outer bar 26 and anchored to the outer bar 26 by the fasteners 48. In the illustrated embodiment, the fasteners 48 are provided by stubs which project from the outer bar 26. This fastener configuration is particularly suitable for use with the endless tensioning member. However, it is to be understood that the fasteners 48 may have other configurations within the scope of this invention.

The amount of resistance supplied by the resistance assembly 16 may be easily adjusted by increasing or decreasing the number of tensioning members 46. The resistance may also be adjusted by selecting tensioning members 46 having a different amount of elasticity. Thus, with the apparatus 10 of the illustrated embodiment, the resistance may be easily and conveniently adjusted without taking the apparatus 10 apart. However, it is to be understood that other types of resistance assemblies, such as springs and the like, may be used in other embodiments of the invention.

The exercise apparatus 10 of this invention may be used to emphasize different muscles and tendons during the exercise session. FIGS. 2 and 3 show an individual using the exercise apparatus 10 in a first position. The apparatus 10 is held with the curve, or concave side, of the apparatus 10 facing the user's body. In this position, the curve or concave side faces in the opposite direction from the back of the wrist of the user's hand. When in this position, the user tends to hold the device between the palm and the distal phalanx, placing the stress on the distal joint. Operation of the apparatus 10 primarily involves the flexor profundus muscle, a muscle in the forearm which is joined by a tendon to the base of the distal phalanx just beyond the distal joint. While other muscles and tendons participate in the repeated back and forth movement of the inner frame 14 relative to the outer frame 12, the emphasis is on the profundus muscle and associated tendons.

FIG. 4 shows the exercise apparatus 10 in a second position, with the curve or concave side of the apparatus 10 facing away from the user's body. In this position, the curve or concave side faces in the same direction as the back of the user's wrist. With the exercise apparatus 10 in this orientation, the user tends to hold the apparatus 10 between the palm and middle phalanx just beyond the middle joint of the finger. Operation of the exercise apparatus 10 when in this position primarily involves the flexor sublimus (or superficialis) muscles of the forearm which are attached by a tendon to the base of the middle phalanx just beyond the middle joint. When the apparatus 10 is in the engaged position, with the inner frame 14 pulled toward the outer handle 24 by the user as shown in FIG. 4, the profundus tendons and profundus muscles are relaxed. While all the muscles working on joints proximal to the middle phalanx are used to move the inner frame 14 relative to the outer frame 12, the emphasis is placed on the flexor sublimus during the exercise.

As is apparent from the forgoing, the exercise apparatus 10 may be used to emphasize specific muscles and tendons, allowing considerable variation in the interaction of the muscles. Typically, a therapist or trainer would develop an exercise program in which the user performs a number of repetitions with the exercise apparatus 10 held in both positions, increasing the versatility of and control over the muscle interactions. This muscle interaction control may be used to develop exercise programs for reducing the occurrence of repetitive stress injuries such as carpal tunnel syndrome.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best use the invention and various embodiments with various modifications as are suited to the particular use contemplated. It is intended that the scope of the invention be defined by the claims appended hereto and their equivalents.

What is claimed is:

1. An exercising apparatus comprising:

an outer frame having spaced first and second spaced-apart parallel rails and an outer handle extending between said first and second rails, said first and second rails being curved in spaced parallel planes which extend through the center of said first and second rails;

a curved inner frame slidably coupled to said outer frame for movement of said inner frame along said first and second spaced-apart curved parallel rails, said inner frame including an inner handle movable toward said outer handle when said inner frame is moved in a first direction; and at least one resistance assembly coupling said inner frame and said outer frame together, said resistance device resisting movement of said inner frame in the first direction.

2. The exercise apparatus of claim 1 in which said first and second rails have a radius of curvature of about three to six inches.

3. The exercise apparatus of claim 1 in which said inner frame includes a pair of spaced-apart curved parallel slides slidably engaging said first and second rails.

4. The exercise apparatus of claim 1 in which said inner handle is rotatable relative to said inner frame.

5. The exercise apparatus of claim 1 in which said inner frame includes an inner bar spaced from said inner handle, said inner bar being rotatable relative to said inner frame.

6. The exercise apparatus of claim 1 in which said resistance assembly includes an outer bar carried by said outer frame, an inner bar carried by said inner frame, and at least one tensioning member coupling said inner bar to said outer bar.

7. The exercise apparatus of claim 6 in which said resistance assembly includes at least one fastener carried by said outer bar, said fastener anchoring said tensioning member to said outer bar.

8. An exercising apparatus comprising:

an outer frame including spaced first and second rails, said first rail extending in a curved path in a first plane extending through the first rail and said second rail extending in a curved path in a second plane extending through the second rail parallel to the first plane;

an inner frame having spaced-apart parallel curved rails slidably coupled to said outer frame for reciprocal movement of said inner frame along said curved first and second rails;

a pair of handle members actuable by a user to move said inner frame along said first and second rails, one of said handle members being carried by said outer frame and the other of said handle members being carried by said inner frame;

a resistance assembly coupled to said inner frame and said outer frame for resisting movement of said inner frame along said first and second rails.

9. The exercise apparatus of claim 8 in which said inner frame has first and second recesses formed therein, said first rail being slidably positioned in said first recess and said second rail being slidably positioned in said second recess.

10. The exercise apparatus of claim 8 in which the one of said handles carried by said outer frame is a handle bar extending between said first and second rails.

11. The exercise apparatus of claim 8 in which the one of said handles carried by said inner frame is rotatable relative to said inner frame.

12. The exercise apparatus of claim 8 in which said resistance assembly includes an outer bar carried by said outer frame, an inner bar carried by said inner frame, and at least one tensioning member coupling said inner bar to said outer bar.

* * * * *